United States Patent [19]

Karlewski

[11] Patent Number: 4,778,140

[45] Date of Patent: Oct. 18, 1988

[54] SUPPORT STAND

[76] Inventor: Tomasz Karlewski, 72 Nassau Ave., Brooklyn, N.Y. 11222

[21] Appl. No.: 17,044

[22] Filed: Feb. 18, 1987

[51] Int. Cl.[4] ..... F16H 13/02

[52] U.S. Cl. ..... 248/524; 248/529; 248/231; 47/40.5

[58] Field of Search ..... 248/524, 523, 507, 519, 248/529, 146, 151, 231, 558; 47/40.5, 42; D 11/130.1, 130

[56] References Cited

U.S. PATENT DOCUMENTS

| | | | |
|---|---|---|---|
| 923,206 | 6/1909 | Singleton | 248/524 |
| 1,151,745 | 8/1915 | Wagner | 248/524 |
| 1,695,275 | 12/1928 | Davis | 248/523 |
| 2,853,261 | 9/1958 | Loeb | 248/529 X |
| 3,295,802 | 1/1967 | Leatherman | 248/523 |
| 4,088,294 | 5/1978 | Aliment et al. | 248/519 |
| 4,190,983 | 3/1980 | Rostomily | 47/40.5 |
| 4,429,846 | 2/1984 | Halvorson | 248/524 |

FOREIGN PATENT DOCUMENTS

| | | | |
|---|---|---|---|
| 338449 | 5/1904 | France | 47/42 |
| 34898 | 5/1908 | Fed. Rep. of Germany | 248/231 |

*Primary Examiner*—Ramon S. Britts
*Assistant Examiner*—Karen J. Chotkowski
*Attorney, Agent, or Firm*—Bierman and Muserlian

[57] ABSTRACT

A stand is provided for supporting an elongated article, such as a Christmas tree, in an upright position having a plurality of support legs wherein each leg has at least two curved flanges mounted thereon for positioning against the article. Each of the flanges are adapted to moveably secure a link at one flange end and to releasingly engage with the link of another supporting leg at the other flange end. At least one of the legs has a quick lock/quick release adjustment lever moveably connected between the flanges and the links and adapted to cooperate therewith to easily lock the support legs against the elongated article or quickly release them therefrom.

8 Claims, 2 Drawing Sheets

SUPPORT STAND

The invention relates to a stand for vertically supporting a post, stem, stud or the like and, more particularly, to a Christmas tree stand with an easily and quickly adjustable connect and disconnect latching mechanism.

BACKGROUND ART

Christmas tree supports are shown in various United States patents. The support of U.S. Pat. No. 4,088,294 is composed of component parts which require a welding or bonding step in the manufacturing process which makes it more expensive to manufacture. Additionally, the adjusting band is of a thread-and-screw type wherein the band is disposed within a slotted portion of the legs and tightens against the tree stem. The support is not due to the interaction of the legs with each other but, rather, to the tension of the single fastening band pressing the slotted portion of the legs directly against the tree trunk. In order to remove the support from the tree, it is necessary to loosen the band and slide the stem out from the support. This is because the support is not of an easy connect and disconnect type. To remove the support without lifting the tree would require threading the entire adjustable band out from the screw portion.

The legs of the support of U.S. Pat. No. 3,295,802 are fastened to a Christmas tree stand in the same manner as the aforementioned reference. Basically, a single band with a thread and screw type clamp is used for tightening the legs against the tree stem. The legs do not interact with each other for purposes of fastening against the tree stem. As with the previous reference, the tree must be lifted in order to remove the stand with any relative degree of expediency. Otherwise, the entire band must be threaded out from the screw device. The band holds two pairs of legs in engagement with opposite sides of the base of the tree. However, the trunks of large trees are engaged only by the edges of leg angles and the band is held on the legs only by tension. Furthermore, the supports preclude placing the base of a supported tree in a container of water without placing at least part of the support itself in such container. Hence, the support will be subject to corrosion or rot from exposure to water or the supported trees will be denied water, have shortened useful lives, and be more likely to become fire hazards.

U.S. Pat. No. 3,733,040 contains many component parts making the support difficult to assemble and expensive to manufacture. The support legs require a base wherein interlocking connection occurs with tabs of the base inserted in holes of the legs. This provides opposite tension against the other end of the legs which are clamped onto the tree. The use of the clamp alone would not work because the legs would slide out from the bottom. Additionally, further support pads are provided to ensure a non-skid surface. Furthermore, the adjustment range for the particular clamp size cannot be much larger or smaller than the clamp diameter. Accordingly, different clamps would be necessary for use with different tree trunk diameters. Moreover, as with the previous references, this support precludes placing the base of the tree in a container of water. Therefore, the tree will have a shortened useful life.

U.S. Pat. No. 2,853,261 shows a "Stabilizer for Containers" using a complicated resilient band holding legs in engagement with a cylinder which is to receive the container to be supported. Rivets are used to support the band around the container. The device is not really a support but, rather, a mechanism for establishing stable equilibrium. This device shares with all the above-noted Christmas tree supports the problem of being designed for a single use.

SUMMARY OF THE INVENTION

A primary object of this invention is to provide a support which ensures proper vertical positioning of a tree or construction stud, or the like, and is held by a quick and easy connect and disconnect fastening device to form a wide stable base for even a large tree.

A further object of this invention is to provide a novel stand for Christmas trees or the like which allows the base of the supported tree to be received in a container of water without placing any portion of the support itself in such container.

Another object of this invention is to provide a tree stand which is self-adjusting to any tree with a diameter size in the range from 2 to 5 inches.

A still further object of this invention is to provide a Christmas tree support, the component parts of which can be adapted to other uses.

The foregoing objects can be accomplished by providing a plurality of support legs for supporting an elongated article, such as a Christmas tree, in an upright position. Each leg has at least two curved flanges and a chain link or strip link connected to one end of the flanges. The curved flanges bear directly against the Christmas tree trunk. The oppositely disposed ends of the flanges are hook-shaped to moveably secure the strip link or chain link at one end and to releasingly engage with a link of another support leg at the other end.

At least one of the support legs has a quick lock-/quick release snap-fastening lever connected between a flange and a secured link. The lever permits tightening of the hook/link assembly of the other support legs around the periphery of the article base. Additionally, this construction allows the quick disassembly and removal of the support stand from the elongated article without time-consuming activity or the necessity of lifting the article out from the support stand. Furthermore, the support legs have an inclined portion to provide space therebetween for receiving a water container into which the base of the Christmas tree trunk can project. As is evident, this stand can also be used for supporting a construction stud, land survey pole or any other post.

BRIEF DESCRIPTION OF THE DRAWINGS

The above features and the further advantages of the invention are described in detail below in conjunction with the accompanying drawings, of which:

FIG. 1A is a partial top perspective view of a support leg and flange of an alternate embodiment;

DETAILED DESCRIPTION OF THE PREFERRED EMBODIMENT

Figures 1, 2:
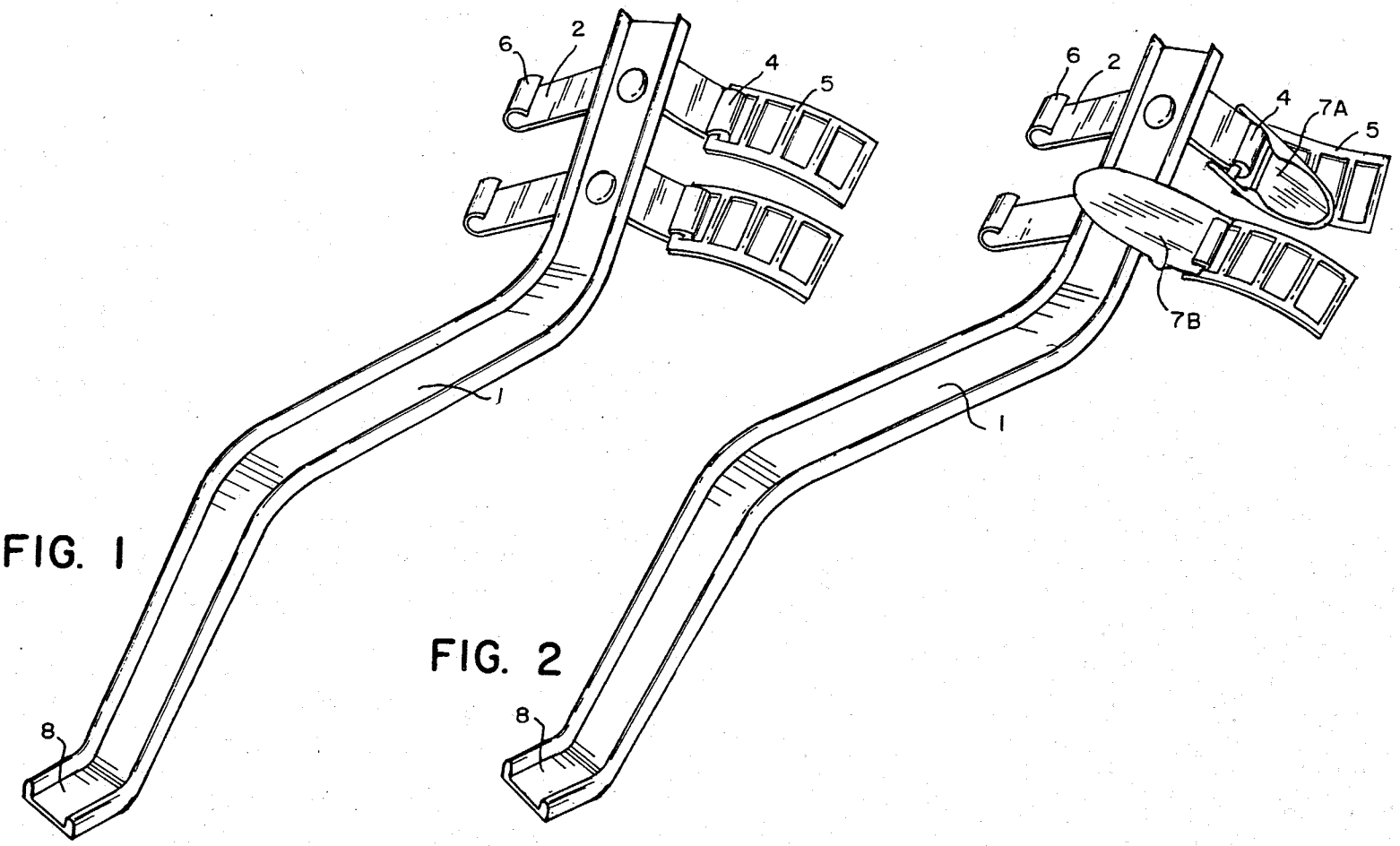
FIG. 1 is a top perspective view of a support leg having the hook/link assembly.
FIG. 2 is a top perspective view of a support leg having a hook/lever/link assembly.
Figure 3:
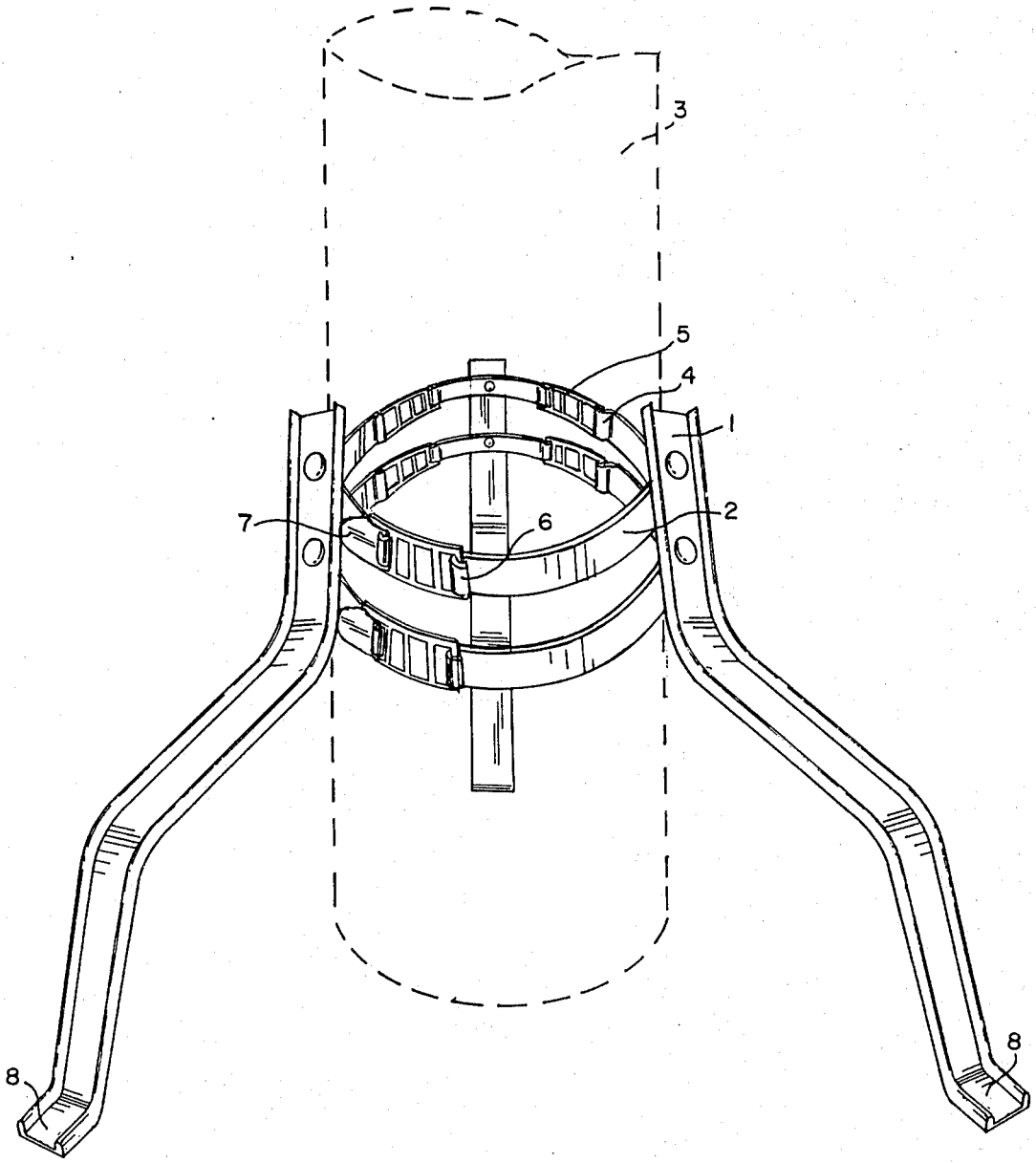
FIG. 3 is a top perspective view of a plurality of support legs of the type shown in FIGS. 1 and 2 interconnected to support an article freestanding, with a tree trunk indicated in broken line.

A novel stand for Christmas trees or the like is shown in FIGS. 1, 2 and 3 of the drawings. The stand is basically preferably composed of 3 or 4 support legs 1 with at least two flanges 2 mounted thereon and extending radially therefrom. As best seen in FIG. 3, the section of support legs 1 having flanges 2 is directed positioned against the periphery of tree trunk 3. Accordingly, flanges 2 are curved to be in substantial conformity with the curvature of cylindrical tree trunk 3, shown in phantom, to be supported.

The oppositely disposed ends 4, 6 of flange 2 comprise the hook/link assembly of the present invention. Closed hook 4 of flange 2 moveably secures link 5 therein so that link 5 can releasingly engage with open hook end 6 of flange 2 of another support leg 1. Link 5 is slightly curved in conformity with the curvature of flange 2.

As best seen in FIG. 3, supporting legs 1 are disposed substantially equiangularly around the base of trunk 3 and are interconnected by the hook/link assembly. One support leg is provided with at least 2 quick lock/quick release levers 7 which are moveably connected between closed hook 4 of flange 2 and link 5 (see FIG. 2).

As seen in FIG. 2, adjustment lever 7A is in the open position to provide easy connection with links 5 and open hooks 6 of the adjoining support legs. Once all support legs 1 are interconnected, adjustment lever 7 is snapped to the closed position 7B to tighten the support stand aound tree trunk 3. Based upon this construction, the present invention is adaptable to any tree trunk having a diameter in the range from 2 inches to 5 inches. Thus, the cooperation of adjustment lever 7 between closed hook 4 and link 5 provides for the easy assembly or disassembly of the support stand from an elongated article. Much larger trees could be supported if the stand had longer legs and/or more than one supporting leg with the hook/lever/link assembly. Supporting feet 8 are provided at the base of legs 1 to provide further stability to the stand. Wben not in use, the support legs can be nested, one inside the other, and stored in a minimum of space.

One of the advantages of the present invention is that it is not necessary to insert tree trunk 3 between support legs 1, as the stand of the present invention can be quickly wrapped around tree trunk 3 by the interconnection of the hook/link assembly and the fastening thereon by adjustment levers 7.

An alternative embodiment of the invention comprises mounting flange 2 on the opposite side of support leg 1, as shown in FIG. 1A. In this manner, cut-outs are formed in support leg 1 so that flange 2 can be connected directly to leg 1 for a tight fit around a supported tree trunk.

The above described embodiments are merely illustrative of and not intented to limit the scope of the invention. Various modifications and substitutions of elements, materials and order or position of elements may be made without departing from the spirit of the invention. All such modifications and variations are intended to be encompassed within the invention as defined in the following claims.

What is claimed is:

1. A stand for supporting an elongated article in an upright position consisting essentially of a plurality of support legs wherein each leg has at least two curved flanges mounted thereon for positioning against said article, each of said flanges having first and second flange ends, a plurality of links movably secured on said first flange end, said second flange end releasingly engaging a link of another support leg, said first flange end comprising a closed hook and said second flange end comprising an open hook, wherein each of said flanges movably secures a link at one flange end and releasingly engages with the link of another support leg at the other flange end, and at least one of said legs has a quick lock/quick release adjustment lever movably connected between said flanges and said links cooperating therewith to easily lock said support legs against said elongated article or quickly release them therefrom.

2. The stand of claim 1 wherein said links are slightly curved in conformity with the curvature of said flanges.

3. The stand of claim 1 wherein supporting feet are located on said legs.

4. The stand of claim 1 wherein said links are strip links or chain links.

5. The stand of claim 1 wherein said flanges are integrally formed on said legs.

6. The stand of claim 3 wherein said legs are bent to allow a container of water to be positioned thereunder.

7. The stand of claim 1 wherein said elongated article comprises a construction stud or a land survey pole.

8. The stand of claim 1 having three support legs.

* * * * *